United States Patent [19]

Gregory et al.

[11] 4,326,656

[45] Apr. 27, 1982

[54] EVACUATED PRINTING PLATEN

[75] Inventors: Floyd A. Gregory, Binghamton; Donald F. Manning, Endicott; William Oranchak, Johnson City, all of N.Y.; Joseph J. Student, deceased, late of Apalachin, N.Y., by Sophie A. Student, administratrix

[73] Assignee: International Business Machines, Armonk, N.Y.

[21] Appl. No.: 162,996

[22] Filed: Jun. 25, 1980

[51] Int. Cl.[3] ..... B65H 17/38; B65H 17/44

[52] U.S. Cl. ..... 226/59; 226/38; 226/195; 242/75.2; 242/76

[58] Field of Search ..... 226/59, 60, 74, 75, 226/76, 77, 78, 79, 80, 81, 82, 83, 84, 85, 86, 195, 196, 95, 97, 38, 39; 242/75, 75.2, 76

[56] References Cited

U.S. PATENT DOCUMENTS

| | | | |
|---|---|---|---|
| 2,746,749 | 5/1956 | Huck | 242/75.2 X |
| 2,778,634 | 1/1957 | Gams et al. | 242/75.2 X |
| 2,967,674 | 1/1961 | Lawrence et al. | 242/75.2 |
| 2,994,489 | 8/1961 | Hare | 242/75.2 |
| 3,151,796 | 10/1964 | Lipschutz | 226/97 |
| 3,259,288 | 7/1966 | Wasserman | 226/60 |

*Primary Examiner*—Stanley N. Gilreath
*Attorney, Agent, or Firm*—Kenneth P. Johnson

[57] ABSTRACT

Printing platen for positioning a recording medium such as paper which includes an evacuated chamber having a slotted face plate for attracting, holding and guiding the paper. Slots are arranged parallel to each other and the direction of paper travel, and the vacuum attraction causes temporary deformation of the paper so that the slots can effect guiding and tension on the paper during advancement. Effective platen length can be varied to accommodate different paper widths.

4 Claims, 2 Drawing Figures

EVACUATED PRINTING PLATEN

BACKGROUND OF THE INVENTION

This invention relates generally to platens for positioning recording mediums and more particularly to an evacuated platen for accurately positioning the medium during recording at a printing station, then guiding the medium during advancement.

In certain recording applications, such as nonimpact printing with ink droplets, the positioning of a paper web becomes critical. Slight lateral motion of the web or variation in the increment of advancement produce noticeable faults in the printing. The permitted positional tolerance is frequently on the order of 0.1 mm at the printing station.

The use of vacuum tensioning devices is well known in the art of controlling paper in web form. Examples of vacuum tensioning devices are disclosed in U.S. Pat. Nos. 2,710,154 and 3,259,288. These devices are used to effect a drag on the web. In the first patent, the guiding means attempts to maintain a constant tension on the web; in the second patent, the vacuum station effects a drag and reserve paper loop which is necessary to obviate the need for phased pairs of drive tractors. The second patent will also prevent the web inertia from causing overshooting at a subsequent printing station when the advancing means suddenly stops after a line spacing operation. These devices, however, do not provide a suitable printing station at the vacuum device and cannot accurately limit the lateral motion of the web during its advance.

A printing station in general requires that the web be maintained flat at the recording area without lateral deviation during advancement. One technique of insuring web alignment is to place the web under tension over a plurality of ridges that are parallel to the motion of the web. An example of such a guiding device is shown in U.S. Pat. No. 3,549,068. The guiding surface of this device, however, is curved and thus unsatisfactory for holding the paper web during printing.

SUMMARY AND OBJECTS OF THE INVENTION

It is accordingly a primary object of this invention to provide a printing station for a paper web having a recording surface with means to maintain alignment of the web and to effect tension on the web during advancement.

Another important object of this invention is to provide a printing station having a recording surface with means to position the web while effecting drag thereon and to limit lateral motion of the web during the advancement.

Yet another important object of this invention is to provide a recording station having means to effect vacuum tension on the web which does not vary directly with the width of the web being recorded.

A still further object of this invention is to provide a vacuum platen at a recording station which produces increased vacuum attraction at the web edges.

Another important object of this invention is to provide improved stability in web control by placing a nonuniform drag across the web during advancement with the greater drag being near the drive source.

The foregoing objects are attained in accordance with the principles of the invention by providing a platen at the printing station which comprises one wall of an evacuated chamber with the platen having elongate slots parallel to the web motion and to each other, thus attracting the paper web against the platen. Except for a certain minimum width of the web, the slots are of decreasing length in progression across the web with occasional full length slots at intervals coincident with web edges for certain standard width papers. A source of vacuum is applied to the manifold to provide a continuous attraction which is effective to hold the paper in position during printing and maintain a tension on the paper during advancement by tractor means selectively operable to pull the web during line spacing operations. The slots are effective to limit lateral motion during movement by forming slight longitudinal, temporary depressions in the paper. The drive source for the tractor is at the edge of the platen having the longer slots and maximum tension to minimize torsion in the tractor drive shaft.

A pair of tractor drive wheels engage opposite sides of the web and the outboard drive wheel is adjustable to accommodate different widths of paper. The outboard drive wheel also has connected thereto a shutter which is effective to block off a portion of the vacuum manifold which may extend beyond the edge of the web to thereby conserve the vacuum for the web-covered portion of the platen.

The foregoing and other objects, features and advantages of the invention will be apparent from the following more particular description of a preferred embodiment of the invention, as illustrated in the accompanying drawing.

DESCRIPTION OF THE PREFERRED EMBODIMENT

Figure 1:
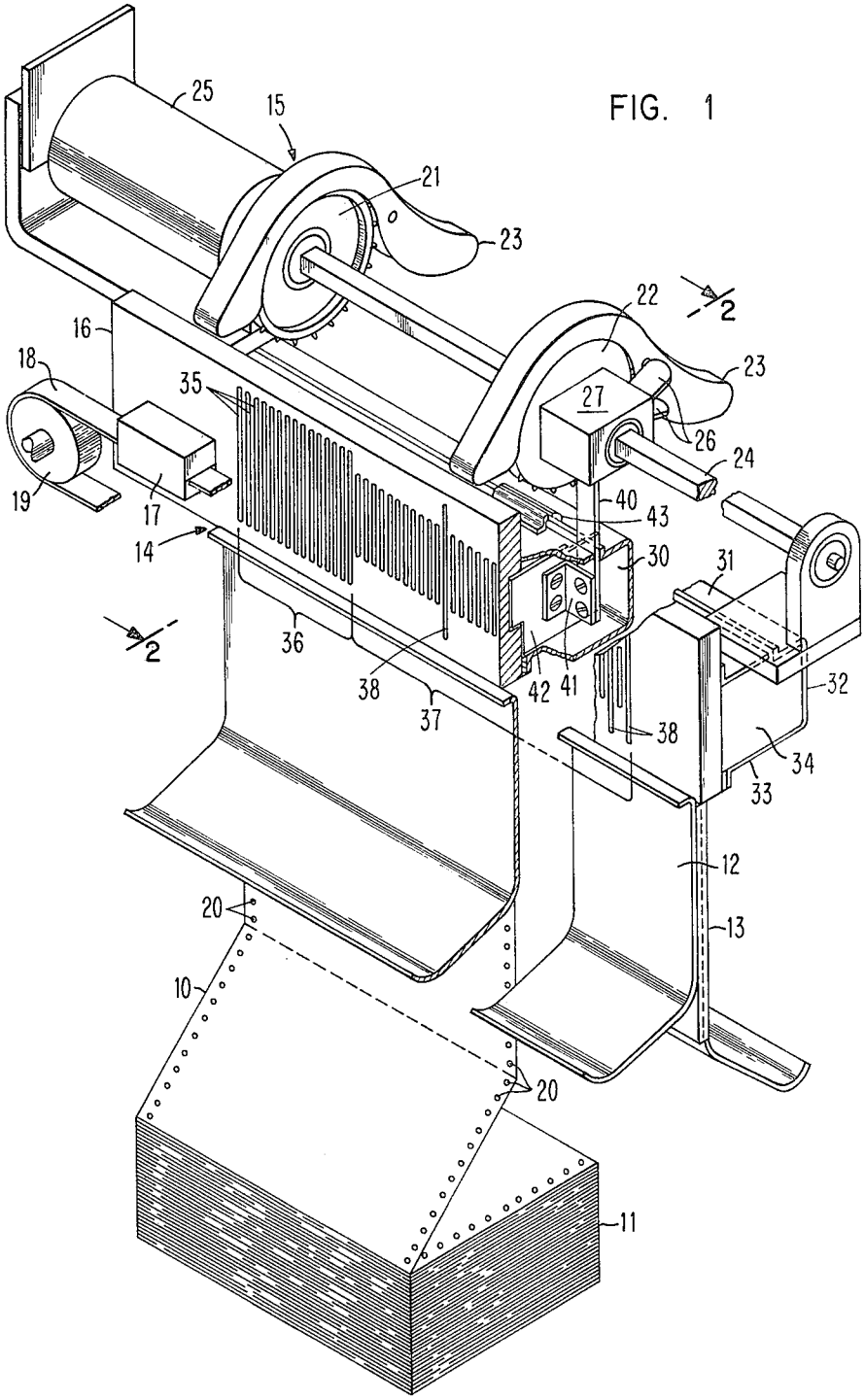
FIG. 1 is a perspective view of a printing platen and associated paper guiding apparatus constructed in accordance with the principles of the invention.

Referring to FIG. 1, there is shown apparatus for moving a continuous paper web 10 from a supply stack 11 between a pair of guides 12, 13, past a printing station generally indicated as 14 over a pair of forms tractors generally indicated as 15 to a discharge point. Printing station 14 includes a platen 16 over which the web 10 is drawn and a print head 17 schematically shown which is reciprocated transversely of the web by a reciprocating belt 18 mounted on pulleys 19. The paper, indicated in phantom, is engaged at its marginal perforations 20 by pin wheels 21 and 22 to pull fresh paper into position at the platen as each line is printed. Guides 23 serve to maintain the engagement between the paper and pins on the pin wheels. The pin wheels are rotated by square shaft 24 driven by motor 25. Pin wheel 22 and its guide 23 are movable in either direction along shaft 24 by operating levers 26 of locking mechanism 27 to accommodate papers of varying widths.

Figure 2:
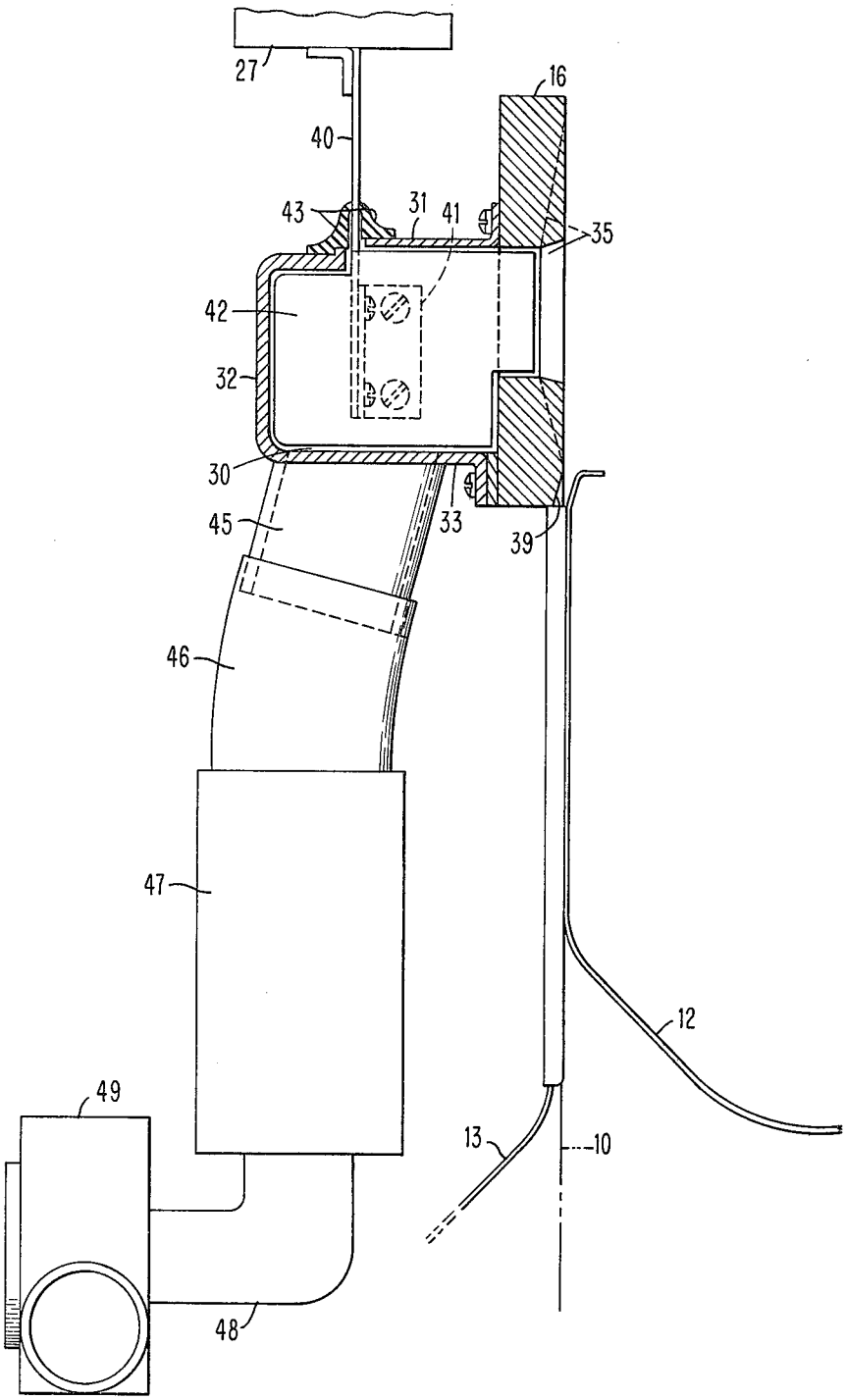
FIG. 2 is a view partially in section taken along the lines 2—2 shown in FIG. 1.

Referring to both FIGS. 1 and 2, platen 16 is constructed as one wall of a vacuum chamber 30 formed by additional walls 31, 32, 33 and end walls 34. Platen 16 is provided with a plurality of slots 35 which communicate with the evacuated chamber 30, thus attracting the web tightly to the surface of the platen. The slots are parallel to the web movement and each other. As seen more clearly in FIG. 2, the slots are extended in the platen to the desired length by means of tapered removal of the platen material. As seen in FIG. 1, the slots are of different lengths to provide vacuum attraction where necessary. The variation in length permits the amount of drag or tension to be controlled according to the width of the paper web 10. For example, at the left end of the platen, a group of slots designated 36 are all of the same length and provide a relatively great attraction force for narrow webs. The remaining slots, designated as a group 37, are each successively shorter in length; however, full length slots 38 are occasionally interspersed.

It is preferable to minimize the load variation for different width forms on motor 25 during a line spacing operation in order to achieve the highest degree of accuracy. The motor has to be selected for the maximum load expected or for a full width web of paper. If the web to be printed is a narrow strip, for example, extending only over slots 36, then the load is insufficient and the motor reaction carries the web too far. Thus, the slots are formed with the maximum length at the end of the platen where narrow webs are to be expected and successively diminish gradually in length as the width increases to the maximum. Occasional long slots 38 may be formed to coincide with the right hand edge of standard widths of paper to aid in attracting and sealing the paper edge and to provide additional paper control onto the tractors. A chamfer 39 is provided at the bottom edge of platen 16 to improve paper guiding.

The surface of platen 16 is preferably a smooth surface for the paper during advancement but may be coated with suitable materials to provide the desired friction characteristics. The slots are of uniform width usually from 2 to 3 mm and vary only in length; the width is a matter of choice dependent on vacuum level and desired paper flatness. Slot length is a function of the amount of friction required and the capacity of the vacuum source to maintain the desired pressure. The remaining platen material between adjacent slots is usually wider than the slot widths by approximately 1 to 2 mm. Paper quality may have some bearing on the dimensions of the slots such as its flexibility or porosity. By maintaining the vacuum at approximately 3 to 4 cm of water in chamber 30, the usual single ply business machine paper will be drawn into the slots such that its depressions will approximate 0.01 mm. The effect of multiple parallel slots is to provide a guiding action as the web is drawn over the slots during a line space or skip operation, thus preventing any significant lateral movement of the web between adjacent recording lines. The slight deformation of the web into the slot prevents the lateral movement.

In the mechanism shown, the left edge of a web to be printed is always at the same point with its marginal perforations aligned with tractor pin wheel 21. To accommodate webs of different widths, tractor wheel 22 is movable by compressing levers 26 of locking mechanism 27 and sliding the wheel 22 along shaft 24 so that it coincides with the right hand paper edge. Also attached to locking mechanism 27 and depending therefrom is an arm 40 secured to a bracket 41 which in turn is attached to a shutter 42. A pair of resilient, flexible strips 43 form a vacuum conserving seal about the slot along which arm 40 moves. The shutter is sized to be freely movable along the interior of chamber 30 and when tractor wheel 22 is moved, the shutter moves therewith to dimension the vacuum chamber to the width of the web currently being recorded. This is effective to maintain the vacuum source substantially constant within the chamber.

As best seen in FIG. 2, chamber 30 is evacuated through a port 45, a duct 46, filter chamber 47, and duct 48 by a suitable motor-fan unit 49. The fan is preferably the high volume type adequate to maintain a vacuum in chamber 30 of approximately 3 to 4 cm of water.

The amount of slot area and slot length along with the coefficient of friction of the platen surface is balanced against the width, weight, porosity and velocity of the paper to provide sufficient drag to control accurately paper motion and inertia. The grouping of the longer slots and gradual decrease in effective vacuum with the shorter slots tends to narrow the range of friction load to be encountered during operation. A second benefit is that the greater tractor load is applied at the left end which is close to the driving source, while the smaller friction load is applied to the outboard or right hand tractor. Shaft torsion is minimized with this design.

While the invention has been particularly shown and described with reference to a preferred embodiment thereof, it will be understood by those skilled in the art that various changes in form and details may be made therein without departing from the spirit and scope of the invention.

What is claimed is:

1. Apparatus for positioning a web of recording medium comprising:

tractor means engaging opposite edges of said web for moving said web;

a chamber extending across the width of said web;

a face plate serving as one wall of said chamber adjacent said web, said face plate having a plurality of parallel slots extending longitudinally in the direction of motion of said web; and means for evacuating air from said chamber to thereby attract said web against said face plate to provide frictional restraint during the motion of said web, with said slots being formed to provide decreasing frictional restraints from one edge of said web to the other.

2. Apparatus as described in claim 1 wherein said slots are arranged in first and second groups with the slots in the first group having common lengths and the slots in said second group having successively decreasing lengths in approaching the other of said edges.

3. Apparatus as described in claim 1 wherein said slots include at least one group each having gradually decreasing length extending across said web and having interspersed therewith slots of length greater than any in said group of decreasing length.

4. In a machine for feeding a web and having means for pulling said web from a source of supply past a recording station, platen means comprising:

a chamber extending across the width of said web;

means for evacuating air from said chamber;

a face plate at said station serving as one wall of said chamber adjacent to the plane of travel of said web, said face plate having a plurality of parallel slots through which air is drawn into said chamber, said slots extending longitudinally in the direction of web motion and being formed in said face plate to gradually decrease the frictional restraint imposed on said web from one edge to the other by vacuum attraction.

* * * * *